US005400458A

United States Patent [19]

Rambosek

[11] Patent Number: 5,400,458

[45] Date of Patent: Mar. 28, 1995

[54] BRUSH SEGMENT FOR INDUSTRIAL BRUSHES

[75] Inventor: Thomas W. Rambosek, Woodbury, Minn.

[73] Assignee: Minnesota Mining and Manufacturing Company, St. Paul, Minn.

[21] Appl. No.: 40,416

[22] Filed: Mar. 31, 1993

[51] Int. Cl.[6] ..... A46B 13/02; A46B 3/00

[52] U.S. Cl. ..... 15/179; 15/193; 15/202

[58] Field of Search ..... 15/186, 187, 192, 193, 15/194, 202, 159.1, 176.4, 179; 300/21

[56] References Cited

U.S. PATENT DOCUMENTS

| | | | |
|---|---|---|---|
| 576,866 | 2/1897 | Look | 15/193 |
| 2,786,222 | 3/1957 | Rolker | 15/193 |
| 2,982,983 | 5/1961 | Peterson . | |
| 3,698,770 | 10/1972 | Landen et al. . | |
| 3,879,903 | 4/1975 | Belanger . | |
| 4,325,902 | 4/1982 | Holding . | |
| 4,525,890 | 7/1985 | Peerman et al. . | |
| 4,821,359 | 4/1989 | Deziel et al. . | |
| 5,016,311 | 5/1991 | Young et al. . | |
| 5,045,091 | 9/1991 | Abrahamson et al. . | |
| 5,083,840 | 1/1992 | Young et al. . | |
| 5,129,191 | 7/1992 | Warner et al. . | |
| 5,155,875 | 10/1992 | Kirkkala | 15/193 |
| 5,233,719 | 8/1993 | Young | 15/179 |

FOREIGN PATENT DOCUMENTS

| | | | |
|---|---|---|---|
| 0513798A2 | 11/1992 | European Pat. Off. . | |
| 661896 | 3/1964 | Italy | 15/193 |

OTHER PUBLICATIONS 3M product literature, "Gridlines" May 1989.

Woodworking News, "Brushlon TM RX Long Trim Wheels Introduced for Wood Finishing".

*Primary Examiner*—David A. Scherbel

*Assistant Examiner*—Randall E. Chin

*Attorney, Agent, or Firm*—Gary L. Griswold; Walter N. Kirn; Daniel R. Pastirik

[57] ABSTRACT

A brush segment for an industrial brush is described. The brush segment includes a polymeric base portion, a plurality of bristles individually anchored to the polymeric base portion and projecting outwardly therefrom and means for securing the brush segment to the hub of a rotary brush. The polymeric base portion preferably comprises a thermoset urethane material. The root member may comprise an extension of material independent of the polymeric base portion which is non-mechanically secured to the polymeric base portion.

7 Claims, 2 Drawing Sheets

FIG. 3
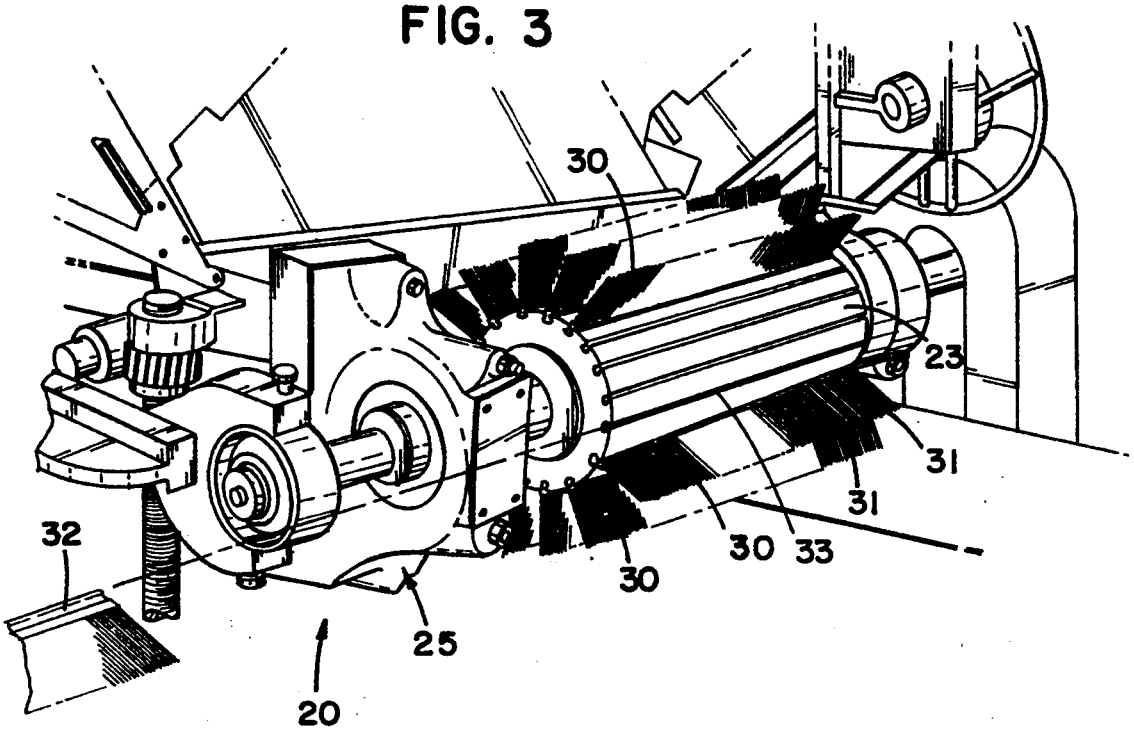
FIG. 1
(PRIOR ART)
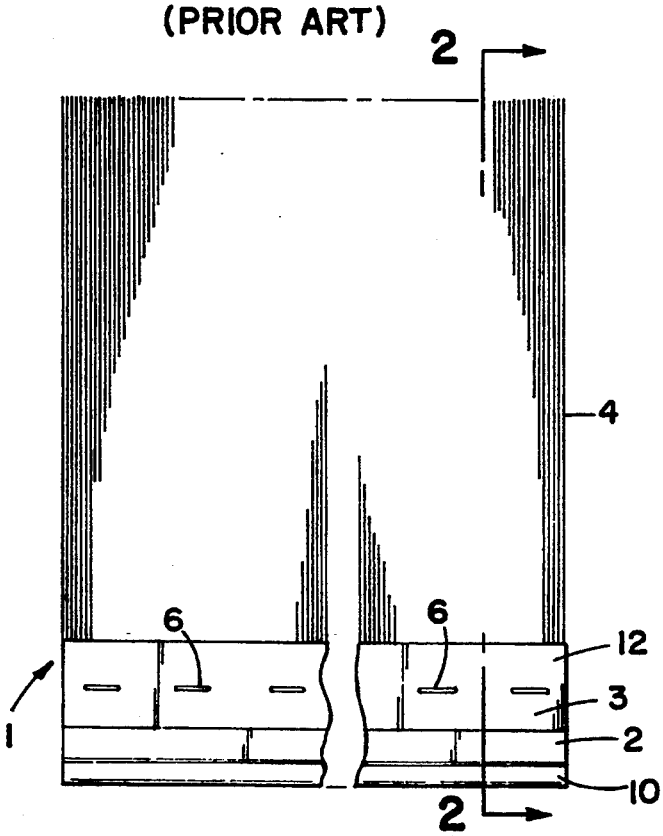
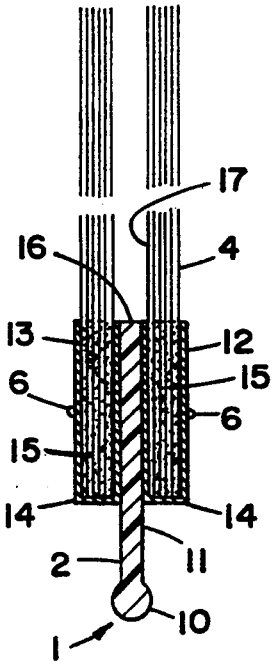
FIG. 2
(PRIOR ART)

BRUSH SEGMENT FOR INDUSTRIAL BRUSHES

FIELD OF THE INVENTION

The present application concerns industrial brushes, and in particular arrangements for mounting of such brushes in association with a carrier substrate. The invention particularly concerns arrangements involving brushes containing long trim fibers.

BACKGROUND OF THE INVENTION

In many industries, abrasive brushes are used to prepare and/or finish materials. The brushes are typically mounted on cylindrical hubs which are rotated during a finishing operation.

A typical industrial cylinder brush arrangement utilizes, as the rotatable hub, a slotted hub construction. In general, slotted hubs comprise elongate cylinders having a plurality of longitudinal slots evenly spaced around the outer surface of the cylinders. Each slot is sized and oriented for anchoring of one or more brush segments thereto. By convention, the number of slots around the outer surface of a cylinder generally comprises five times the diameter (in inches) of the hub; the conventional diameters for hubs generally being 3, 4, 6, 8, 10, 12 and 14 inches (i.e. about 7.6; 10.2; 15.2; 20.3; 25.4; 30.5; and, 35.6 cm respectively).

In many conventional applications of longitudinal slotted hubs, each brush segment is mounted by means of a single elongate root member. The root members are such that each brush segment is capable of some hinge-like movement or pivoting movement (i.e., gating, rocking or flapping) with respect to the hub, during use.

A conventional abrasive member or segment is depicted in FIGS. 1 and 2. In particular, the reference numeral 1, FIG. 1, depicts a conventional brush segment, such as available under the trade designation "Brushlon", from Minnesota Mining and Manufacturing Company, Saint Paul, Minn. 55144 (3M). Segment 1 is of a type utilizable with a conventional cylinder hub, such as an "RX" brand aluminum hub, also available under the trade designation "Brushlon" or "Brushlon/RX", from 3M.

Segment 1 generally comprises a root 2, scrim wrapped section (fiber pack) 3, and bristles or fibers 4. In general, root 2 is configured for engagement with slots, on a slotted hub. Scrim wrapped section 3 secures ends of fibers 4 in position. Scrim wrapped section 3 is mechanically mounted on root 2, by staples 6 which extend completely through the segment 1. For a typical long trim brush segment (before wear during use), fibers 4 will have a length of extension, out of scrim wrapped section 3, of at least about 2 inches (at least about 5 cm), and typically at least about 3–12 inches (i.e. about 7.5–30.5 cm). Referring to FIG. 2, root 2 includes an expanded base portion (bottom bead or ball portion) 10 and a neck portion 11. As will be understood by reference to FIG. 2, brush segment 1 generally has two packs or sections of scrim 3 (with fibers 4 mounted therein) one on each side of neck portion 11. These are indicated generally at reference numerals 12 and 13, respectively.

Each of sections 12 and 13 comprises a fold of scrim material 14 with ends of fibers 4 projecting thereinto. The fibers 4 are held in place by cores of hot melt resin 15 received within scrim material 14. A conventional hot melt resin utilized for this purpose is polyamide thermoplastic.

Brush segments such as those illustrated in FIGS. 1 and 2 have been utilized in a variety of environments. However, they are subject to loss of bristles or fibers therefrom, especially when used in wet or caustic environments, or with organic solvent solutions. Also, the staples 6 and scrim material 14 occupy width which is wasted, i.e., not occupied by the presence of bristles. Further, end 16 of root 2, FIG. 2, generates a space 17 which is wasted in a similar manner, because the sections of bristles (12 and 13) must be anchored on opposite sides of neck 11. That is, due to space 17, brush segment 1 is a low density brush.

SUMMARY OF THE INVENTION

According to the present invention there is provided a brush segment for a finishing brush such as a rotary brush. The brush segment generally comprises: (a) a polymeric base portion; (b) a root member having a neck portion; said root member neck portion being embedded in said polymeric base portion and being non-mechanically bonded thereto; and, (c) a plurality of bristles individually imbedded in said polymeric base portion to project outwardly therefrom in a direction generally opposite to said root member; at least some of said bristles being positioned over said root member neck portion.

The polymeric base portion preferably comprises a thermoset urethane material of appropriate characteristics to resist degradation or loss of bond on extreme use conditions. In certain preferred embodiments, the root member comprises material (independent of the polymeric base portion) which is embedded in the polymeric base portion and which is non-mechanically secured (i.e. which is adhered or bonded) thereto.

BRIEF DESCRIPTION OF THE DRAWING

FIG. 1 is a fragmentary side elevational view of a prior art brush segment arrangement.

FIG. 2 is a fragmentary cross-sectional view taken generally along line 2—2, FIG. 1.

FIG. 3 is a schematic perspective view of an industrial cylinder brush arrangement having brush segments thereon, according to the present invention.

FIG. 5 also depicting a portion of a cylinder hub on which the brush segment is mounted and an analogous brush segment in side elevation.

FIG. 7 being a view generally analogous to FIG. 5.

DETAILED DESCRIPTION OF THE INVENTION

Figure 6:
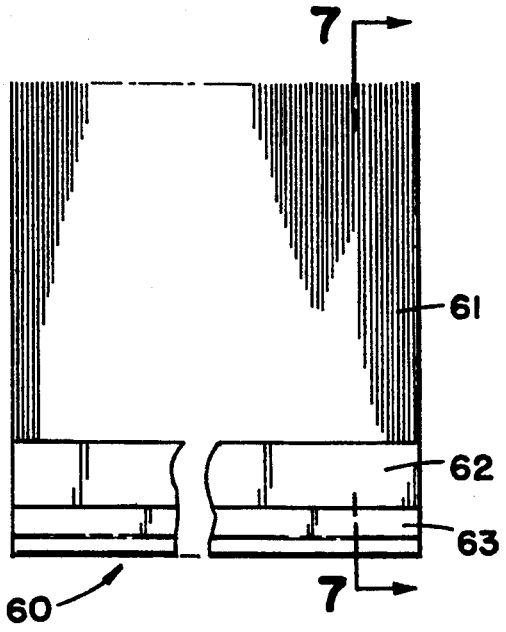
FIG. 6 is a fragmentary side elevational view of a brush segment according to an alternate embodiment of the present invention.

As indicated above, the present invention concerns industrial cylinder brush arrangements, in particular long trim arrangements. The arrangements may be used on rotary or non-rotary hub arrangements, however, they are particularly well adapted for use with rotary hubs.

FIG. 3 generally illustrates an industrial cylinder brush finishing device 20 including a cylinder brush according to the present invention including a plurality of improved brush segments therein. Specifically, device 20 comprises a horizontally mounted cylinder hub 23, mounted in mechanical device 20 such that hub 23 can be selectively rotated at preferred speed, typically about 900 to 1200 rpm, to achieve a surface speed of the hub of 2200–4400 surface feet per minute (670–1340 meters per min.). Arrangement 20 generally not only includes a drive mechanism 25 for hub 23, but also adjustive means (not detailed) for selected positioning of the hub 23 relative to a path of movement of articles to be treated upon passage through the arrangement 20. The hub 23 may be generally as described in U.S. Pat. No. 5,083,840 incorporated herein by reference.

Device 20 further includes a plurality of brush segments 30 mounted thereon. Each brush segment 30 extends longitudinally along hub 20, with bristles 31 projecting outwardly therefrom. As hub 23 is rotated, bristles 31 are spun into contact with an article, to finish same. In a long trim wheel, such as that depicted, a considerable "flapping" action occurs, as the bristles (and to some extent other portions of the brush segments) rock in relation to the hub 23 and brush against a substrate. Typically, a "rock" or "flap," (i.e. more than mere bending of the fibers or bristles) on the order of at least about 5 degrees, typically about 10 to 20 degrees, will occur.

In FIG. 3, a brush segment 32 is shown in orientation for mounting, i.e. sliding into a slot 33 on hub 23.

Figure 5:
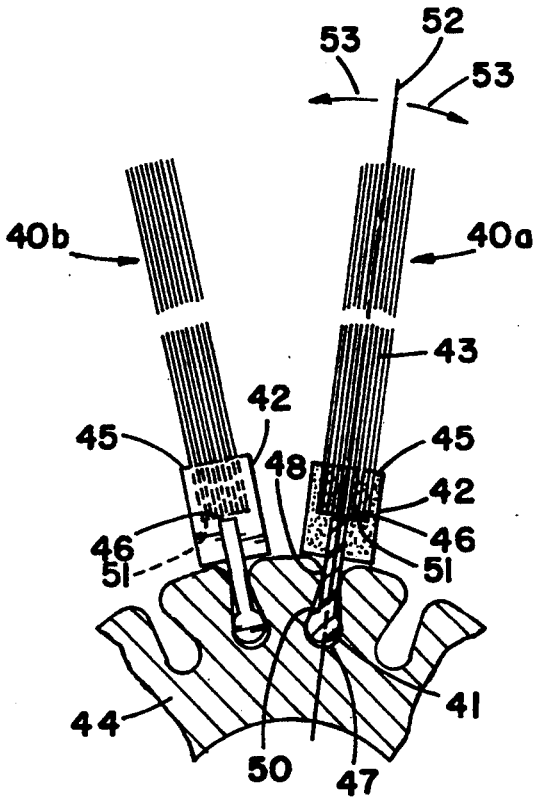
FIG. 5 presents a cross-sectional view of the arrangement shown in FIG. 4, taken along line 5—5 thereof.
Figure 4:
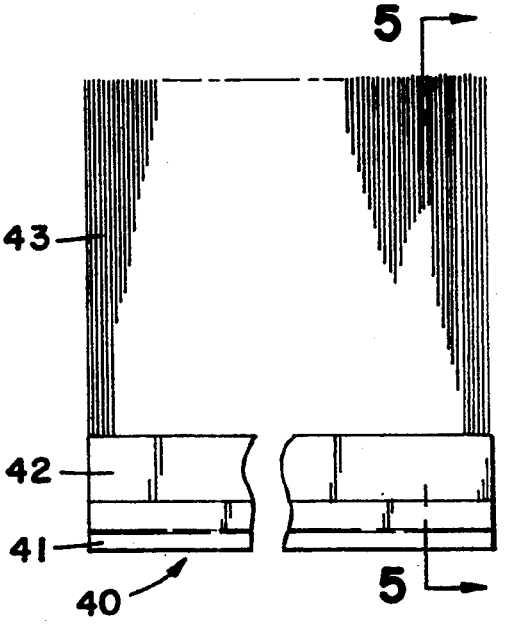
FIG. 4 is a fragmentary side elevational view of a brush arrangement according to the present invention.

Brush segments according to one embodiment of the present invention are illustrated in FIGS. 4 and 5. In reference to FIG. 4, a brush segment according to the present invention is generally indicated at 40. Brush segment 40 may be utilized as one of brush segments 30, FIG. 3. Brush segment 40 generally includes a root member 41, a polymer block or base 42, and bristles 43. The bristles 43 are individually anchored within polymer base 42, i.e. an end of each bristle 43 is embedded in the polymer of base 42. The arrangement of FIG. 4 contains no scrim; and, no mechanical connection (staples) for the various parts is needed. By the term "mechanical connection" and variants thereof in this context it is meant that no mechanical devices such as staples or rivets are necessary to ensure secure attachment of the root member to the polymer base; rather a bond or adhesion (non-mechanical connection) between the two is provided.

Herein, the longitudinal extension of the polymer block or base 42 (left to right in FIG. 4) will be referred to as the "width" or "face width" of the brush segment 40. The extension from the surface of the hub to the outer tip of the fibers, FIG. 5, will be referred to as the "length" of the brush segment. The dimension through the polymer block (left to right in FIG. 5) will be referred to as the thickness.

In FIG. 5, a fragmentary view of a hub 44 is shown, with segments 40 mounted therein. Two adjacent segments **40*a* and 40*b* are depicted. To facilitate understanding, one segment 40*a* is depicted as a cross-section of FIG. 4, the other (40*b***) is not.

Referring to FIG. 5, bristles 43 are substantially evenly distributed to project outwardly from upper (outer) surface 45 of base 42. Thus, the arrangement of FIG. 2 is readily distinguished. There is no central gap, analogous to gap 17, FIG. 2, in the arrangement of FIG. 5. That is, bristles 43 are distributed to occupy the space immediately "above" or "over" end 46 of root member 41, as shown.

Polymer base 42 is not mounted on root member 41 by mechanical means such as staples. Rather, polymer base 42 comprises a polymer which is cured (molded) on root member 41, to be secured (adhered or bonded) thereto. For preferred embodiments, the resin is the sole means of attachment of the base 42 to the root member 41.

Root member 41, analogously to root member 2, FIG. 2, includes an expanded base (bead or ball) 47 and a neck portion 48. Base 47 and neck portion 48 are sized and configured for engagement within longitudinal slot 50 of an industrial brush cylinder hub 44. In addition, neck 48 should extend up into polymer block 42 sufficiently, for secure engagement. Generally, an extension of neck 48 of at least about 0.19 inch (about 0.5 cm) and preferably about 0.25–0.5 inch (0.6–1.3 cm) into polymer block 42 will be sufficient.

Preferably, arrangements **40*a* and 40*b*, FIG. 5, are constructed such that neck portion 48 terminates, as indicated at 46, beneath bottom ends 51 of bristles 43. Thus, again, gaps such as indicated at 17, FIG. 2, are avoided by the present arrangement. A 200–300% fiber density increase and related improvement in performance over the arrangement of FIGS. 1 and 2**, can be readily achieved because of the absence of the gap and absence of scrim and mechanical connector. In addition, greater flexibility in allowing for variations in fiber density (to optimize for particular applications) is possible with arrangements according to the present invention. Also, the thick fiber density obtainable allows the fibers to support one another.

Hereinabove, reference has been made to an amount of "rocking" or flapping movement in the brush segments, during use. In FIG. 5, this movement would be total angular bending or flapping (deflection) about central axis 52 in the directions of arrows 53 from one extreme to another.

PREFERRED MATERIALS AND DIMENSIONS

While a variety of materials may be utilized in constructions according to the present invention, particular preferred materials lead to advantageous properties of the construction, especially with respect to: strength of the root member to resist breaking in use (for example, due to the stresses of the flapping); and, resistance to bristle fallout, or loss, (especially when used under humid, wet or caustic conditions; or when heated; or when used with a solvent solution).

THE BRISTLES

The bristles may be formed from a variety of materials, including: metallic wire; plastic coated wire; and plastic filaments. Materials from which metallic wire bristles can be made include: steel; brilling copper; stainless steel; "Z" nickel; copper, brass, bronze, and aluminum alloys. For plastic coated wires, the plastic coatings may include: nylon; vinyl plastic; trifluorochloroethylene polymer, neoprene and copolymers of butadiene and acrylonitrile. Examples of usable plastic filaments include nylon, polypropylene, polyethylene, and polyester materials. The bristle materials may include abrasive particles (such as silicon carbide) impregnated into the bristles. Commercially available (preferred and useable) bristle materials include those known under the trade designation "TYNEX" bristles (silicon carbide impregnated 6,12 nylon) available from DuPont de Nemours, Wilmington, Del. 19898, or polypropylene bristles available from E. B. and A. C. Whiting Co., Burlington, Vt. 05402.

For typical long trim applications, the bristles should be sufficiently long to extend outwardly from the resin or polymer base 42 a distance of at least 2 inches (about 5 cm), and typically at least about 3–12 inches (about 7.5–30.5 cm). The bristles should be embedded within base 42 a distance sufficient for secure anchoring, generally at least about 0.25 inch (about 0.6 cm) and typically about 0.3–0.9 inch (not including wicking), i.e. about 0.8–2.3 cm. A preferred arrangement is one wherein the bristles are sufficiently long to provide a brush segment length to thickness ratio of at least 3 and preferably at least within the range 5–19.

THE ROOT MEMBER

It is important that the root member comprise material which can withstand the stresses of use due to heat buildup during rotation, pressures associated with finishing operations and the extra stresses generated by the flapping action of the brush member in operation. It has generally been found that polymeric materials having the following properties will be preferred: hardness-Shore A (BSI Method 365A, Part 3, incorporated herein by reference) at least 94, preferably at least 97 and most preferably offscale, Shore D (ASTM:E 448-82, incorporated herein by reference) at least 50, preferably at least 52 and most preferably 55–72; % elongation at break, at least 300%, preferably at least 325%, and most preferably 350–450%; tensile stress at break preferably at least 5200 psi (pounds per square inch) (i.e. about 36.5 MPa (MegaPascals)) more preferably 5700 psi (about 39 MPa) and most preferably about 5900 to 6600 psi (about 41–45.5 MPa); flexural modulus at −40° F. 100,000–350,000 psi (690–2400 MPa), at 93° F. 30,000–85,000 psi (200–590 MPa) and at 212° F. 16,000–30,000 psi (110–210 MPa). By "offscale" with respect to hardness (Shore A) it is meant that the material is too hard to get an onscale measurement by the test.

It is presently foreseen that thermoset urethane materials can be utilized as the root members. Other materials such as polymer blends of copolyester/polyacrylate/polyester may be used. Preferred materials, commercially available, are the segmented thermoplastic elastomer polyesters known under the trade designation "Hytrel" 5556, "Hytrel" 6256 and "Hytrel" 7246, available from DuPont, Wilmington, Del. 19898, which can be readily extruded in a strip form of appropriate shape and dimension.

Preferred dimensions for the root member, when used in association with an RX hub or the like, are: total height (ball portion to tip of neck portion) at least about 0.80 inch (2 cm) (typically 0.87–1.0 inch or 2.2–2.5 cm); length of neck portion, at least about 0.625 inch or 1.6 cm (typically 0.75–0.87 inch or 1.9–2.2 cm); thickness of neck portion about 0.095–1.05 inch (0.15–0.2 cm); diameter of lower expanded ball portion 47 (bead), about 0.23 to 0.25 inch (0.56–0.64 cm).

THE BASE PORTION

The base portion 42 preferably comprises a polymeric material which can be readily processed to include both the bristles and the root member secured therein with mechanical connections; and, which will withstand the conditions of use sufficiently to provide secure engagement with the root member and bristle material throughout use. Material which can (optionally) be utilized under wet and/or caustic finishing conditions will be preferred.

Preferred materials for utilization of the polymeric base are cured (thermoset) urethanes. The resin materials from which the urethane is formed should be such as to provide a cured urethane having the following properties: hardness: at least 90 Shore A, preferably at least 95, and most preferably 97 to offscale; at least 50 Shore D, preferably at least 52 and most preferably 54 to 60; elongation: at 100% elongation at least 1100 psi (about 7.6 MPa), more preferably 1500–2100 psi (10.4–14.5 MPa), and most preferably 1700–1900 psi (about 11.7–13.1 MPa); at 300% elongation: at least 2200 psi (about 15.2 MPa) preferably 3200 to 5000 psi (about 22.1–34.6 MPa) and most preferably 4200–4800 psi (about 29–33.2 MPa); tensile stress at break: preferably at least 3900 psi (about 27 MPa), preferably 4300 to 5600 psi (about 29.7–38.7 MPa) and most preferably 4700 to 5300 psi (about 32.5–36.5 MPa). If the polymer base is formed from a material as defined, generally the brush will: remain intact at high operation rotative speeds; remain intact under wet or caustic conditions; and, will resist deterioration under heat build-up in use.

The uncured resin mixture from which the polymeric base is formed should preferably provide a viscosity at 72° F. (22° C.), of 10,000–34,000 centipoise, for ease of handling.

Commercially available resin materials may be utilized to form the cured urethane of the polymer base. Preferred materials include those polyesters known under the trade designation "Adiprene" L-767 (a polyester-TDI), cured with a curing agent known under the trade designation "Caytur" 21 (a complex of methylene dianiline, i.e. MDA, and sodium chloride, dispersed in dioctyl phthalate); or the polyester known under the trade designation "Adiprene" L-315 (a polyester-TDI or toluene diisocyonate) cured with a curing agent known under the trade designation "Caytur" 21; available from UniRoyal Chemical Co., Middlebury, Conn. 06749. Such materials are preferred since they provide the physical strengths and properties toward the preferred ends of the ranges stated above; and, can be processed readily with an avoidance of substantial porosity. (In general, porosity in the resin leads to a weak system, more likely to break or lose its integrity during use.) Other usable commercially available urethane resin systems include those known under the trade designations "Vibrathane" B-600, B-601, B-615, B-621 or B-627 (polyether-toluene diisocyanates, i.e. polyether-TDI's), cured with 4,4'-methylene-bis(2-chloroaniline) (i.e. MOCA); "Vibrathane" 8080 or 8050 (polyether—TDI's), cured with MOCA; "Vibrathane" B-625, B-635 or B-670 (i.e. polyether-diphenylmethane diisocyanates or polyether—MDI's), cured with "Vibracure" 3095; and "Vibrathane" 6012 or 8022 (polyether—MDI's), cured with either 1,4-butanediol (1,4-BDO) or "Vibracure" 3095; the "Vibrathane" and "Vibracure" products being available from Uniroyal Chemical Co., Inc. Air Products and Chemicals, Inc. (of Allentown, Pa. 18105) urethanes "1080" or "1090" (polyether—TDI's), cured with MOCA; or Miles, Inc. (of Pittsburgh, Pa. 15205) "410", "2680" or "2690" (polyester—TDI's), cured with MOCA could also be used.

In general, resins which exhibit a heat blocked cure are preferred over those which exhibit an exothermic room temperature cure. Although either may be utilized, resins which exhibit exothermic room temperature cure will generally require small batch mixing due to limited pot life or the need for in-line meter-mix systems. Resin systems which provide for heat blocked cures, can be mixed and will remain generally latent until heated during processing to the appropriate cure temperature. The two preferred commercially available resin systems described above (the Adiprene systems) exhibit the desirable properties of heat blocked cure.

Preferred dimensions for the polymer base (42) are: sufficient depth to provide secure anchoring of both the root member and the bristles (generally at least 0.4 inch (1 cm), typically 0.6–1.0 inch (1.5–2.5 cm); and, a thickness no greater than would allow 2 segments with such polymer bases 42, FIG. 5, to be mounted adjacent to one another in adjacent slots on a conventional slotted hub. Generally a thickness of at least 0.5 inch (1.25 cm), typically at least about 0.625 inch (1.58 cm) will be appropriate.

METHOD OF MANUFACTURE

A variety of methods of manufacture may be utilized, for brush segments as described in FIGS. 4 and 5. Conventional molding techniques can be utilized. In general, an appropriate root member (already extruded and cured) is placed in a mold of appropriate configuration. The thermoset resin is poured in, around a neck portion of the root member to which the polymeric base is to be secured. The fibers are dropped into the polymeric block and are held in place as the polymeric block is cured. The preferred bristle density is about 4.8–8.0 grams of bristles per inch brush segment face width per inch bristle length, or about 0.75 to 1.25 grams of bristles per cm brush segment face width per cm bristle length.

In some instances it may be important to pretreat the surface of the root member, prior to immersion in the thermoset resin of the polymer base, in order to ensure a good bond between the two. If the commercially available polyester "Hytrel" is utilized as the root member, for example, an outer skin of the extruded root member (in the neck portion) should be removed by sanding or otherwise roughening the outer surface of the neck portion to be immersed in the polymer base. In general, a roughening of the surface of the root member neck portion facilitates secure engagement (bonding) between the root member and the polymer base by increasing surface area, so that the cured product will resist delamination.

ADJUVANTS

A variety of adjuvants may be utilized in polymer systems for both or either of the polymer base or the root member. Such adjuvants include, for example, conventional fillers, dyes, and/or antistatic agents.

FIGS. 6 AND 7

Figure 7:
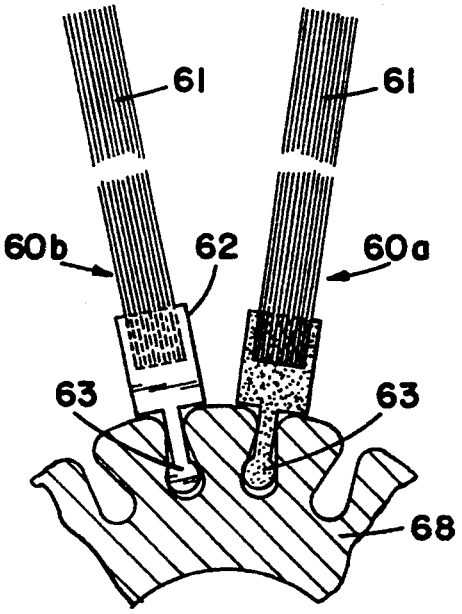
FIG. 7 presents a cross-sectional view of the brush segment shown in FIG. 6, taken along line 7—7 thereof.

In some applications, the base portion and root member may be molded, simultaneously, from a single resin system. Such a construction is illustrated in FIGS. 6 and 7. Referring first to FIG. 6, brush segment 60 comprises bristles 61, polymer base 62, and root member 63. Referring to the cross section illustrated in FIG. 7, it will be understood that the polymer base 62 and root member 63 are of a unitary construction, molded from a single resin system. In FIG. 7, reference numeral **60*a* refers to a cross-section of arrangement 60, FIG. 6, and numeral 60*b* refers to a side elevational view. Arrangements 60*a* and 60*b* are depicted, in FIG. 7, mounted in hub 68**.

It is foreseen that such systems may be readily constructed provided the resin system utilized provides for a cured material of appropriate strength to meet the minimum needs of the root member. That is, the root member is subjected to substantial lateral forces of stress during use, due to the previously described flapping action of the long trim brush segment. For the arrangement shown in FIGS. 4 and 5, it was not necessary for the resin material of the polymer base to be quite as strong as the material for the root member. Such will not be the case, however, for the arrangement of FIGS. 6 and 7.

In general, it is foreseen that the resin system from which the polymer base 62 and root member 63 of FIGS. 6 and 7 is formed, should provide a cured material having the properties described above with respect to the arrangement of FIGS. 4 and 5, for the root member. The preferred dimensions and other features described above for the embodiment of FIGS. 4 and 5 will be generally applicable for the arrangement of FIGS. 6 and 7.

EXPERIMENTAL PROCEDURE

The following examples further illustrate the invention. The following abbreviations and trade names are used throughout.

UR1 urethane resin, commercially available from Uniroyal, Middlebury, Conn., under the trade designation "Adiprene L-767";

C1 resin curative, commercially available from Uniroyal, Mishawaka, Ind., under the trade designation "Caytur 21";

B1 6, 12 nylon bristles, filled with 120 grade silicon carbide, commercially available from DuPont, Wilmington, Del., under the trade designation "Tynex";

B2 crimped 6, 12 nylon bristles, filled with 80 grade aluminum oxide, commercially available from DuPont, Wilmington, Del., under the trade designation "Tynex";

R1 root portion, overall length 0.928 inch (about 2.35 cm) with neck segment 0.688 inch (1.75 cm) and 0.24 inch (0.6 cm) diameter ball portion, comprising extruded copolyester/polyacrylate/polyester, commercially available from DuPont, Wilmington, Del., under the trade designation "Hytrel 5556".

GENERAL BRUSH SEGMENT PREPARATION PROCEDURE

The urethane resin, UR1, and the resin curative, C1, were mixed together by hand in the ratio recommended by the manufacturer, 100 parts to 38.3 parts. Approximately 1 to 3 parts of a polyol/carbon black solution were added to produce a black coloring to the resin. The mold for the formation of the brush segments was a hinged mold that could be clamped by jaws to retain the desired shape and hold the root portion in the desired place. R1 was cut to the desired length, the neck portion was scuffed with a non-woven abrasive wheel, and the root portion was placed into the base of the mold with approximately 0.375 inch (0.95 cm) of R1 actually extending into the mold cavity to be exposed to the resin. Care was taken that the edges between the root portion and the mold were secure so that no resin would seep out. The resin mixture was poured into the mold to the desired level, and the bristles, held together by a clamp, were inserted into the resin to a depth of 0.813 inch (including wicking) i.e. 2 cm. The clamping jaw was removed from the resin mold, and the root segment, including the bristle clamp, was placed in a conventional oven until the resin was sufficiently cured so that the bristles were securely fastened into the resin and the brush segment could be removed from the mold without any shape deformation, approximately 30 minutes at about 225° F. (110° C.), plus a 15 minute rise to temperature.

TEST PROCEDURE 1

The brush segments were soaked in a caustic solution with pH 12 or higher (more basic) at a temperature of 180°-200° F. (82°-93° C.) for approximately three 8 hour periods. The bristles were then manually pulled to determine if the resin had weakened.

TEST PROCEDURE 2

The brush segments were soaked in a solvent solution commercially available from Alumax Extrusions, Inc., St. Charles, Ill., under the trade designation "HM Coolant", at a temperature of 180°-200° F. (82° to 93° C.) for approximately three 8 hour periods. The bristles were then manually pulled to determine if the resin had weakened.

TEST PROCEDURE 3

The brush segments were mounted in a 4" diameter (10.16 cm), 2 inch face width (about 5 cm) slotted hub. The hub rotated at 1100 rpm, with a ⅜" (0.95 cm) constant interference deflection. The workpiece was a 12" (30.48 cm) diameter 304 stainless steel disc face which rotated at about 3 rpm with oscillation.

EXAMPLE 1

Example 1 was made according to General Brush Segment preparation Procedure. The bristles B1 were inserted into the resin mix. The resulting brush segment was 2.0 inches (5 cm) face width, the trim was 6.5 inches (about 16.5) long, and the fiber bed thickness was 0.375 inch (about 0.95 cm).

EXAMPLE 2

Example 2 was made according to General Brush Segment Preparation Procedure. The bristles B2 were inserted into the resin mix. The resulting brush segment was 2.0 inches (about 5 cm) face width, the trim was 6.5 inches (about 16.5 cm) long, and the fiber bed thickness was 0.563 inch (about 1.43 cm).

| | Results | |
|---|---|---|
| | Example 1 | Example 2 |
| Test 1 | no pull out | no pull out |
| Test 2 | no pull out | no pull out |

-continued

| | Results | |
|---|---|---|
| | Example 1 | Example 2 |
| Test 3 | 400* | 300* |

*Hours run. No failure observed, even at the endpoint.

What is claimed:

1. A brush segment for an industrial brush; said brush segment comprising:
   (a) a polymeric base portion;
   (b) a root member having a neck portion embedded in said polymeric base portion and being non-mechanically bonded thereto, said root member comprises a material having the following properties:
      (i) hardness (Shore A)—at least 94;
      (ii) hardness (Shore D)—at least 50;
      (iii) % elongation at break—at least 300%;
      (iv) tensile stress at break, at least 5200 psi; and,
   (c) a plurality of bristles each having first and second ends, the first ends individually embedded in said polymeric base portion such that each of said second ends project outwardly therefrom in a direction generally opposite to said root member; at least some of said bristles being positioned over said root member neck portion.

2. A brush segment according to claim 1 wherein said polymeric base portion comprises a thermoset urethane.

3. A brush segment for a brush; said brush segment comprising:
   (a) a polymeric base portion comprising a thermoset resin; said polymeric base portion having the following properties:
      (i) hardness (Shore A) at least 90;
      (ii) hardness (Shore D) at least 50;
      (iii) tensile stress at break at least 3900 psi; and,
      (iv) 100% elongation at a stress of at least 1100 psi;
   (b) a plurality of bristles each having first and second ends, the first ends individually anchored in said polymeric base portion such that each of said second ends projects outwardly therefrom; and,
   (c) a single root member means for securing said brush segment to a hub, each of said bristles positioned substantially over said single root member.

4. A segment according to claim 3 wherein said polymeric base portion comprises a urethane material.

5. A segment according to claim 3 wherein said root member means for securing said brush segment to a hub comprises a root member including a neck portion, said neck portion being embedded in said polymeric base portion.

6. A segment according to claim 3 wherein said root member means comprises a material having the following properties:
   (i) hardness (Shore A) at least 94;
   (ii) hardness (Shore D) at least 50;
   (iii) % elongation at break at least 300%; and,
   (iv) tensile stress at break at least 5200 psi.

7. A brush segment according to claim 3 wherein said means for securing said brush segment to a hub comprises an elongate root member molded from a portion of said polymeric base portion.

* * * * *